US005685538A

United States Patent [19]

Schlageter

[11] Patent Number: 5,685,538

[45] Date of Patent: Nov. 11, 1997

[54] SHEET REGISTRATION AROUND TURN

[75] Inventor: Alan G. Schlageter, Ontario, N.Y.

[73] Assignee: Xerox Corporation, Stamford, Conn.

[21] Appl. No.: 652,400

[22] Filed: May 23, 1996

[51] Int. Cl.[6] ..... B65H 9/00

[52] U.S. Cl. ..... 271/250; 400/642; 271/188; 271/273

[58] Field of Search ..... 271/273, 161, 271/188, 272, 250; 400/624, 625, 634, 636, 641, 642

[56] References Cited

U.S. PATENT DOCUMENTS

| | | | |
|---|---|---|---|
| 4,231,562 | 11/1980 | Hori | 271/3.1 |
| 4,268,021 | 5/1981 | Rutishauser et al. | 400/629 |
| 4,420,149 | 12/1983 | Schultes et al. | 400/625 |
| 4,621,801 | 11/1986 | Sanchez | 271/251 |
| 4,663,527 | 5/1987 | Koyama et al. | 271/161 |
| 4,744,555 | 5/1988 | Naramore et al. | 271/251 |
| 5,152,623 | 10/1992 | Yamanda et al. | 400/642 |
| 5,253,861 | 10/1993 | Schmaling | 271/273 |
| 5,326,011 | 7/1994 | Mager et al. | 400/636 |
| 5,456,456 | 10/1995 | Abe et al. | 271/10.09 |
| 5,530,466 | 6/1996 | Fujioka et al. | 400/641 |
| 5,558,322 | 9/1996 | Nakatomi | 271/273 |

FOREIGN PATENT DOCUMENTS

| | | | |
|---|---|---|---|
| 208625 | 10/1985 | Japan | 400/625 |
| 404133940 | 5/1992 | Japan | 271/272 |

OTHER PUBLICATIONS

M.C. Hogenes, "Extendible Baffles," Zerox Disclosure Journal vol. 11, No. 1, pp. 27 Jan., 1986.

*Primary Examiner*—Edgar S. Burr
*Assistant Examiner*—Daniel J. Colilla
*Attorney, Agent, or Firm*—John M. Kelly

[57] ABSTRACT

An apparatus for registering substrates while they are partially in a turn baffle assembly. The apparatus includes a registration transport assembly and a turn baffle assembly having a pinch roller assembly. The pinch roller assembly includes a set of pinch rollers which feed the substrate through the turn baffle assembly and into the registration transport assembly. The pinch roller assembly also includes a motion inducing device for selectively moving one pinch roller away from the other and a low friction roller which is somewhat larger than one of the pinch rollers. The low friction roller is located near a pinch roller such that when the pinch rollers are moved apart, the low friction roller biases the substrate way from a pinch roller so as to reduce or eliminate friction between the substrate and that pinch roller.

2 Claims, 3 Drawing Sheets

SHEET REGISTRATION AROUND TURN

FIELD OF THE INVENTION

This invention relates to substrate registration in a handler having a turn baffle.

BACKGROUND OF THE INVENTION

Quick and accurate registration of substrates onto a platen or within a paper transport is useful in environments such as copiers, scanners, and printers. If a substrate is improperly situated the resulting copy, scan, or print will be skewed or incomplete. Therefore, copiers, scanners, and printers frequently include automatic document handlers and automatic paper. transports that move substrates from a holding bin into a predetermined position or along a predetermined path.

In many applications the automatic handlers and transports must be able to register a wide range of substrates. For example, substrates may be comprised of materials which range from short and light "onion skin" paper to long and heavy parchment. To handle such a wide range of substrates prior art automatic document handlers and transports typically moved substrates from the holding bin, along a paper path, and onto a generally planer registration transport. The registration transport, which was usually longer than the longest substrate to be handled, moved the substrate at an angle into a predetermined position along a registration guide. If the registration transport was part of a document handler the substrate was moved from an input bin onto a platen. After copying or scanning the automatic document handlers then moved the substrate along another paper path to a holding bin. If the registration transport was part of an automatic paper transport the substrate was moved from a storage bin into a desired relationship with another component. For example, if the automatic paper transport was part of an interposer paper handier a sheet of paper might be moved from a storage bin into a predetermined relationship with a developed image on a photoreceptor or on an intermediate transfer belt. For simplicity, the term substrate handler will be used generically to refer to any of the many different types of automatic document handlers and paper transports.

While prior art substrate handlers were generally successful, modern copiers, scanners, and printers beneficially have a footprint small enough to sit on a desk. Because most prior art registration transports were planer it was difficult to make a copier, scanner, or printer with a footprint smaller than the registration transport (assuming the registration transport was horizontal). Furthermore, in many prior art substrate handlers the registration transport must be sufficiently long to ensure that the longest document that is to be registered can be brought into proper registration. This further increased the footprint. To reduce making the footprint even longer prior art substrate handlers used turn baffle assemblies, devices which change the direction of substrate motion.

Turn baffle assemblies typically include high friction, motor driven pinch roller assemblies which propel the substrate through the turn baffle. Such pinch roller assemblies include cooperative sets of pinch rollers, one pinch roller being motor driven and contacting one side of the substrate, the cooperating pinch roller, which is usually not driven but is free to turn, contacting the opposite side of the substrate. To assist substrate registration the cooperating non-motor driven pinch roller can be made selectively movable so as to be driven into and out of contact with the document. For example, U.S. Pat. No. 4,621,801, issued on 11 Nov., 1986 to Sanchez, at column 12, lines 51–63 describes a device for selectively driving a pinch roller away from the cooperating pinch roller, thereby reducing frictional pressure on a document. By reducing friction that document could begin to be registered when the document is still in the turn baffle. This was beneficial because the turn of the document within the turn baffle assembly stiffen the document.

However, simply driving one pinch roller away from the cooperating pinch roller does not fully solve the problems caused by friction. The substrate still continues to rub against the high friction stationary pinch roller (the motor-driven one) and is therefore subjected to various stresses when moved. Those stresses can be sufficient to make registering a substrate within the turn baffle assembly difficult. Thus, in the prior art it was customary to ensure that the substrate fully cleared all of the turn baffle pinch rollers before registering.

Therefore, a technique of reducing or eliminating frictional contact between a substrate within a turn baffle and the adjacent pinch roller would be beneficial. A technique which is low cost and readily implemented would be even more beneficial.

SUMMARY OF THE INVENTION

The present invention provides for a substrate handling apparatus which includes a registration transport assembly and a turn baffle assembly having a pinch roller assembly. The pinch roller assembly includes a cooperating set of pinch rollers which feeds a substrate through the turn baffle assembly and into the registration transport assembly. The pinch roller assembly includes a motor driven first pinch roller for contacting a first side of a substrate and a second pinch roller for selectively contacting a second side of the substrate. The pinch roller assembly further includes a mechanical motion inducing device for selectively moving the second pinch roller into a first position which contacts the substrate, driving it into contact with the first pinch roller, and to a second position away from the substrate. The pinch roller assembly further includes a low friction roller which is larger than the first pinch roller. The low friction roller is located near the first pinch roller such that when the second pinch roller is moved to the second position the low friction roller moves the substrate way from the first pinch roller so as to reduce or eliminate frictional forces between the substrate and the first pinch roller. Beneficially the second pinch roller is moved away from the substrate when the substrate is engaged by the registration transport.

BRIEF DESCRIPTION OF THE DRAWINGS

In order that the invention may be more fully understood, a preferred embodiment thereof is described with reference to the accompanying drawings in which.

DETAILED DESCRIPTION OF THE PREFERRED EMBODIMENT

Figure 1:
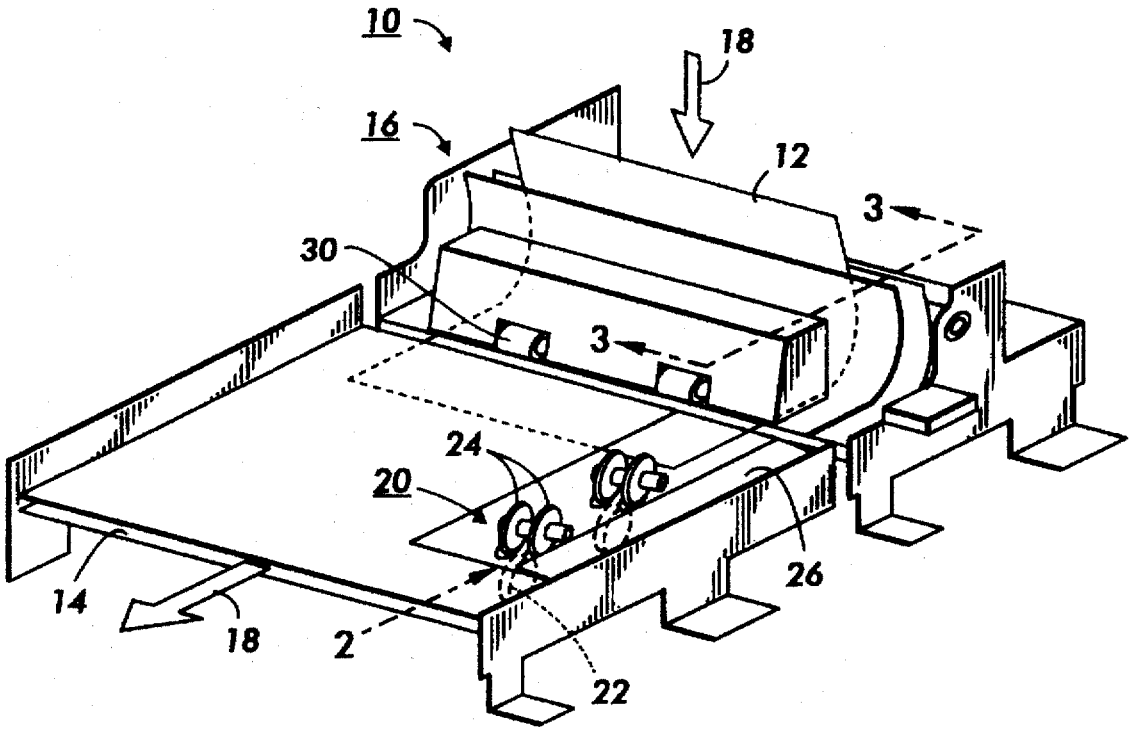
FIG. 1 is a perspective view of a turn baffle assembly and a registration assembly of a substrate handling apparatus.

Reference is now made to FIG. 1 wherein there is illustrated an embodiment of part of a substrate handling apparatus 10 according to the principles of the present invention. The complete substrate handling moves substrates from an input bin, along a paper path, into the part illustrated in FIG. 1. The purpose of the illustrated part of the substrate handling apparatus 10 is to receive a substrate 12, to change its direction of motion, and to advance that substrate along a predetermined path.

The direction of the substrate 12 is changed by passing the substrate through a turn baffle assembly 16. As the substrate advances vertically (in the direction 18) its direction is changed such that it moves horizontally. When the leading edge of the substrate advances to a registration transport assembly 20 the substrate is moved, into a predetermined position on a platen 14. It is to be understood that while FIG. 1 shows a platen, and while the following discusses registering a document on that platen, the principles of the present invention can be used in many other applications. For example, the substrate handling apparatus could be for moving a blank sheet of paper from a storage bin into a predetermined position relative to a developed image. In that application the substrate handler would not have a platen.

Figure 2:
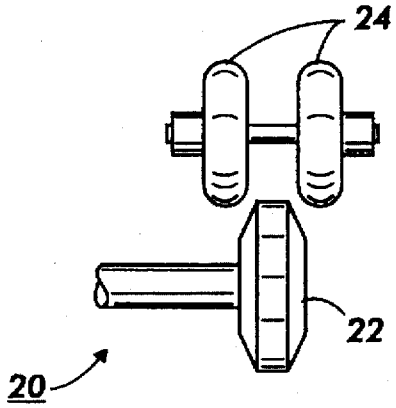
FIG. 2 is a schematic view of the apparatus of FIG. 1 taken along section 2—2.

Still referring to FIG. 1, the registration transport assembly 20 is comprised of one or more sets of registration rollers which are aligned at an angle to the substrate. Referring now to FIG. 2, each set of registration rollers includes a lower driven roller 22 and two upper rollers 24. When the substrate advances into contact with the registration rollers the driven roller 22 moves the substrate at an angle toward a registration guide 26 (see FIG. 1). The substrate contacts that registration guide and is caused to advance along the registration guide to a predetermined position. When the substrate reaches the predetermined position a sensor (which are not shown for simplicity) senses the substrate and generates a signal which stops the driven roller from advancing the substrate further. After the substrate is scanned or copied the driven roller advances the substrate to the remainder of the document handling assembly for advancement to a holding bin.

The foregoing general description is well known in the prior art. It is also known to place one or more sets of registration rollers within the turn baffle assembly 16. For example, see U.S. Pat. No. 4,621,801 (cited earlier). Placing sets of registration rollers within the turn baffle assembly has the advantage that the lateral strength of the substrate is increased by the buckle created by turning the substrate. However, as previously explained, those systems may not be optimal.

Figure 3:
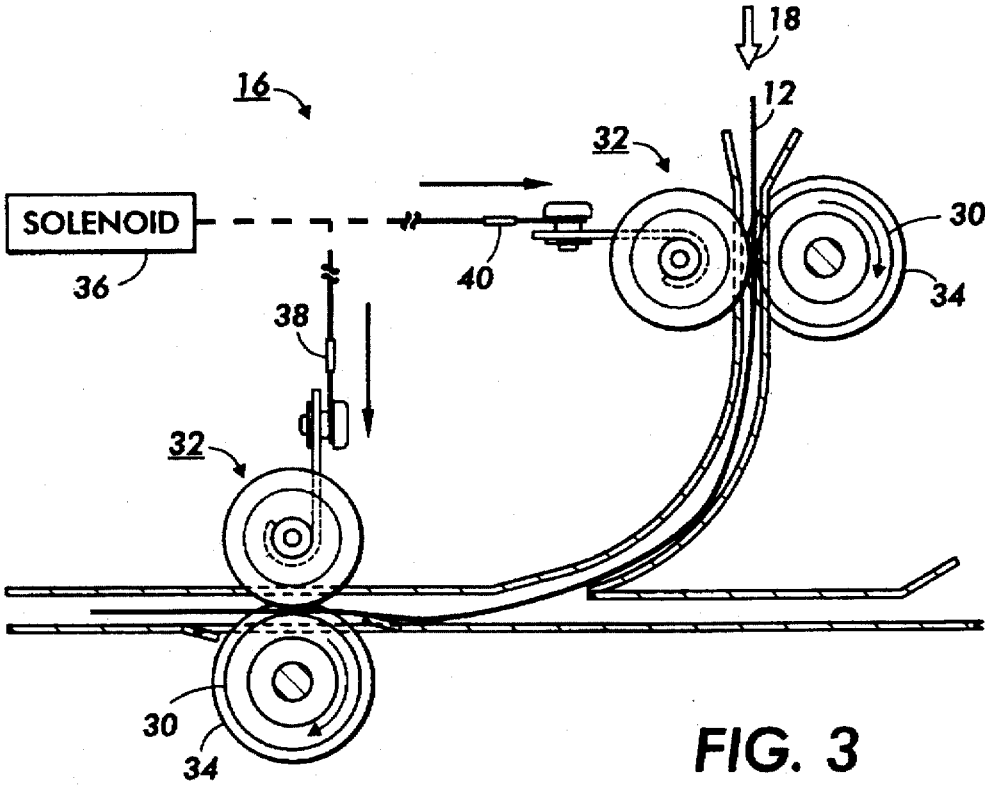
FIG. 3 is a schematic view taken along section 3—3 of inside the turn baffle assembly when the second pinch roller is moved into a first position so as to form a nip with the first pinch roller.
Figure 4:
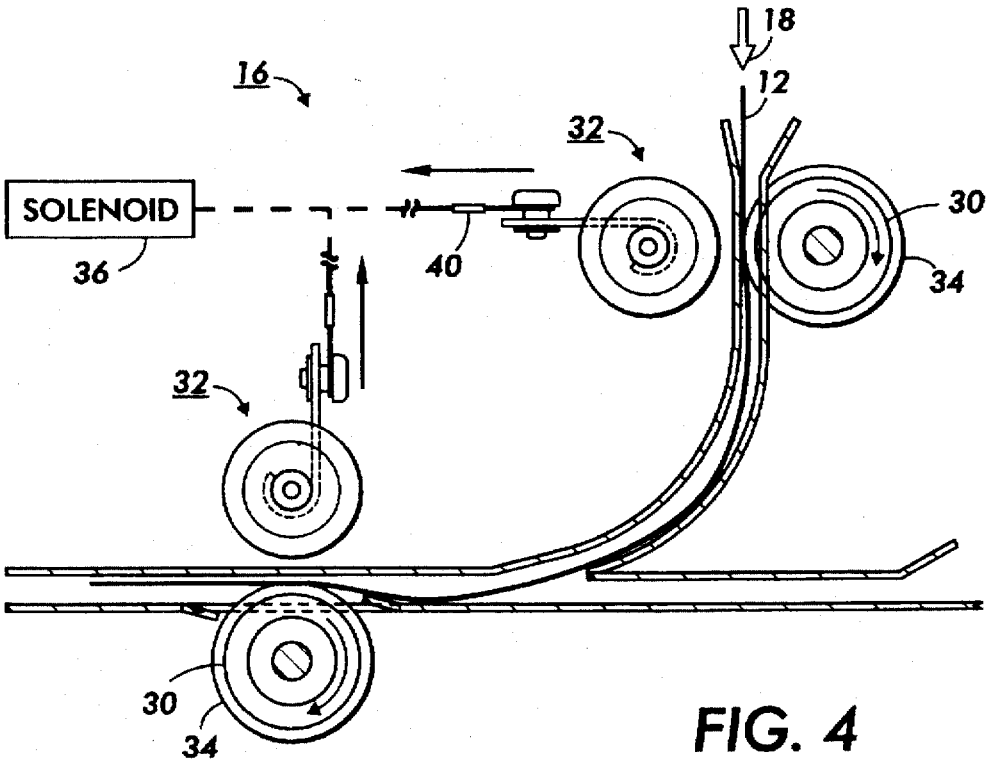
FIG. 4 is a schematic view taken along section 3—3 of inside the turn baffle assembly when the second pinch roller is moved away from the first pinch roller.
Figure 5:
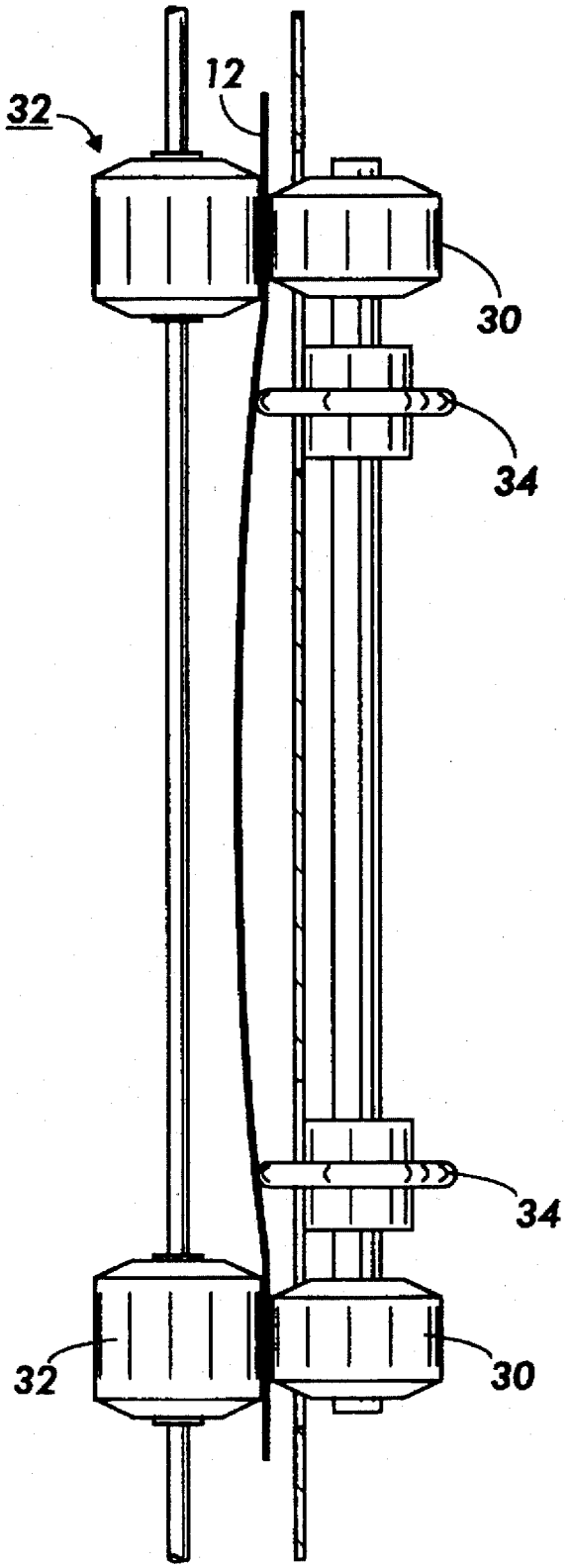
FIG. 5 is a schematic view of the interaction of the first pinch roller, the second pinch roller, and the low friction roller.

The principles of the present invention can best be understood by reference to FIGS. 3, 4, and 5. FIGS. 3 and 4 show simplified schematic views of inside the turn baffle assembly taken along section 3—3, while FIG. 5 is a simplified view which assists in understanding the interaction of the various rollers.

Turning now to FIG. 3, the turn baffle assembly 16 includes sets of pinch rollers, each set comprised of first pinch rollers 30, second pinch rollers 32, and low friction rollers 34. The turn baffle assembly further includes a solenoid 36, and mechanical linkages 38 and 40. FIG. 3 shows the solenoid activated so as to drive the linkages such that the second pinch rollers 32 are driven toward the first pinch rollers 30. This creates a nip through which a substrate 12 passes. As the first pinch rollers 30 are motor driven (by a motor which for simplicity is not shown), as the second pinch rollers are free to rotate, and as the first and second pinch rollers are comprised of a high friction material such as rubber, the substrate is driven through the turn baffle assembly 16.

However, when the leading edge of the substrate advances to the registration transport assembly 20 the solenoid 36 is energized such that the driven second pinch rollers 32 are moved away from the first pinch rollers 30. This condition is illustrated in FIG. 4. As shown in FIG. 4 the first pinch rollers 30 have a smaller radius than the low friction rollers 34. Without the second pinch rollers driving the substrate into contact with the first pinch rollers the substrate rides on the low friction rollers. This allows the registration transport assembly to easily register the substrate when the substrate is partially within the turn baffle.

While FIGS. 3 and 4 show one solenoid having linkages to multiple second pinch rollers, in practice it may be preferable to use multiple solenoids so as to simplify the various mechanical interactions. Multiple solenoids have the advantage that individual second pinch rollers can be selectively driven toward their associated first pinch rollers. This would allow various second pinch rollers to be moved away from their associated first pinch rollers while other second pinch rollers continues to drive the substrate through the turn baffle assembly.

FIG. 5 is a useful view for understanding the principles of the present invention. When the second pinch rollers 32 are moved toward the first pinch rollers 30 the low friction rollers 34 are not significant and the substrate is moved as in the prior art. However, when the second pinch rollers are driven away from the first pinch rollers the low friction rollers, which have a radius greater than that of the first pinch rollers, move the substrate away from the first pinch rollers. The result is a significant reduction in frictional forces on the substrate.

While the foregoing description and figures illustrate the present invention, they are exemplary only. Skilled workers in the applicable arts will recognize numerous modifications and adaptations which will remain within the principles of the present invention. For example, one could move the second rollers and the low friction rollers toward and away from the first rollers. Therefore, the present invention is to be limited only by the claims.

What is claimed:

1. A substrate handling apparatus, comprising:

a registration guide for guiding a substrate along a predetermined path;

a turn baffle for receiving a substrate and for changing the direction of motion of said substrate;

a pinch roller assembly within said turn baffle, said pinch roller for moving a substrate received by said turn baffle through said turn baffle, said pinch roller assembly having a first pinch roller having a radius; a second pinch roller, a friction roller having a lower coefficient of friction than said first pinch roller and having a radius greater than the radius of said first pinch roller, and a motion device for selectively moving said second pinch roller to a position adjacent said first pinch roller so as to form a nip within said turn baffle through which said substrate passes, said motion inducing device further for selectively moving said second pinch roller away from said first pinch roller, wherein said friction roller is located sufficiently near said first pinch roller such that when said second pinch roller is moved away from said first pinch roller that a substrate located between said first and second pinch rollers is biased away from said first pinch roller; and a registration apparatus for receiving a leading section of a substrate as said substrate passes between said first and second pinch rollers, said registration apparatus moving said substrate into contact with said registration guide;

said motion inducing device moving said second pinch roller away from said first pinch roller responsive to a substrate being received by said registration apparatus.

2. The substrate handling apparatus according to claim 1, further including a platen for receiving a substrate from said registration apparatus.

* * * * *